US009546782B2

(12) United States Patent
Mitchell et al.

(10) Patent No.: US 9,546,782 B2
(45) Date of Patent: Jan. 17, 2017

(54) ACCESS RESISTANT LED LIGHT

(71) Applicant: Kason Industries, Inc., Newnan, GA (US)

(72) Inventors: Brett A Mitchell, Newnan, GA (US); Raymond J Hiller, Newnan, GA (US)

(73) Assignee: Kason Industries, Inc., Newnan, GA (US)

( * ) Notice: Subject to any disclaimer, the term of this patent is extended or adjusted under 35 U.S.C. 154(b) by 134 days.

(21) Appl. No.: 14/519,608

(22) Filed: Oct. 21, 2014

(65) Prior Publication Data

US 2015/0036355 A1 Feb. 5, 2015

Related U.S. Application Data

(63) Continuation-in-part of application No. 13/761,010, filed on Feb. 6, 2013, now Pat. No. 8,950,893.

(51) Int. Cl.

| | |
|---|---|
| ***F21V 17/12*** | (2006.01) |
| ***F21V 29/15*** | (2015.01) |
| ***F21V 23/00*** | (2015.01) |
| ***F21V 29/507*** | (2015.01) |
| *F25D 27/00* | (2006.01) |
| *F21Y 101/00* | (2016.01) |

(52) U.S. Cl.

CPC ..... *F21V 29/15* (2015.01); *F21V 17/12* (2013.01); *F21V 23/009* (2013.01); *F21V 29/507* (2015.01); *F21Y 2101/00* (2013.01); *F25D 27/00* (2013.01)

(58) Field of Classification Search

CPC ..... F21V 17/12; F21V 23/023; F21V 29/507
See application file for complete search history.

(56) References Cited

U.S. PATENT DOCUMENTS

| | | | |
|---|---|---|---|
| 5,765,940 | A | 6/1998 | Levy et al. |
| 6,179,447 | B1 | 1/2001 | Ishikawa et al. |
| 6,361,192 | B1 | 3/2002 | Fussell et al. |
| 6,371,637 | B1 | 4/2002 | Atchinson et al. |
| 6,439,743 | B1 | 8/2002 | Hutchison |
| 6,481,873 | B1 | 11/2002 | Smith |
| 6,601,983 | B1 | 8/2003 | Runfola et al. |
| 6,739,734 | B1 | 5/2004 | Hulgan |
| 6,853,151 | B2 | 2/2005 | Leong et al. |
| 6,860,628 | B2 | 3/2005 | Robertson et al. |
| 6,905,227 | B2 | 6/2005 | Wu |
| 7,049,761 | B2 | 5/2006 | Timmermans et al. |
| 7,114,830 | B2 | 10/2006 | Robertson et al. |
| 7,249,865 | B2 | 7/2007 | Robertson |
| 7,293,898 | B2 | 11/2007 | Kumthampinij et al. |

(Continued)

FOREIGN PATENT DOCUMENTS

| | | |
|---|---|---|
| AU | 723764 | 9/2000 |

*Primary Examiner* — Karabi Guharay
(74) *Attorney, Agent, or Firm* — Baker, Donelson, Bearman, Caldwell & Berkowitz, PC

(57) ABSTRACT

There is disclosed a LED light (10) including a lower housing (14), an upper housing (15), and a thermally insulative base gasket (16). The upper housing has a top wall (31) with a central mounting area (35) and a peripheral margin. The lighting portion includes a LED light array (37), a lens (48), and a lens gasket (49). The lower housing is coupled to the upper housing by a set of mounting screws (47). The LED light array is mounted to the top all of the upper housing through mounting screws (61) which are accessible only when the upper housing is disconnected from the lower housing.

7 Claims, 3 Drawing Sheets

(56) References Cited

U.S. PATENT DOCUMENTS

| | | | |
|---|---|---|---|
| 7,360,926 | B2 | 4/2008 | Lee |
| D569,543 | S | 5/2008 | Toda |
| 7,434,970 | B2 | 10/2008 | Machi et al. |
| 7,487,781 | B2 | 2/2009 | Horiuchi et al. |
| 7,488,086 | B2 | 2/2009 | Wu et al. |
| 7,507,001 | B2 | 3/2009 | Kit |
| 7,510,299 | B2 | 3/2009 | Timmermans et al. |
| 7,549,781 | B2 | 6/2009 | Kim et al. |
| 7,688,526 | B2 | 3/2010 | Lu et al. |
| 7,758,227 | B1 | 7/2010 | Coleman |
| D631,567 | S | 1/2011 | Lodhie |
| 7,862,204 | B2 | 1/2011 | Lodhie |
| 8,382,334 | B2 | 2/2013 | Vanden Eynden et al. |
| 8,550,670 | B2 | 10/2013 | Boyer et al. |
| 2003/0102810 | A1 | 6/2003 | Cross et al. |
| 2004/0012959 | A1 | 1/2004 | Robertson et al. |
| 2007/0070621 | A1 | 3/2007 | Rivas et al. |
| 2009/0109674 | A1 | 4/2009 | Lodhie |
| 2012/0250339 | A1 | 10/2012 | Nichols |
| 2012/0250340 | A1 | 10/2012 | Nichols |

ACCESS RESISTANT LED LIGHT

REFERENCE TO RELATED APPLICATION

This is a continuation-in-part of U.S. patent application Ser. No. 13/761,010 filed Feb. 6, 2013.

TECHNICAL FIELD

This invention relates generally to a light, and more particularly to an LED light which is designed to prevent direct access to the LED light elements.

BACKGROUND OF INVENTION

Light fixtures with light bulbs mounted thereto have existed for many years. Oftentimes, light fixtures are utilized in cold environments such as walk in refrigerators and freezers to provide light. However, today's governmental regulations requires that lighting used in commercial refrigeration meets stringent lumen per watt efficiency standards. The standards virtually eliminate previously used incandescent light bulbs under normal conditions because they are inefficient generators of light and they create a large amount of heat in the refrigerated space.

As such, refrigerated spaces are now provided with enclosed and gasket water proof incandescent fixtures with a translucent cover, oftentimes referred to as "jelly jar" covers. A compact florescent bulb (CFL) is currently utilized with these fixtures. However, these CFL bulbs suffer from problems relating to their placement within cold environments such as refrigerated spaces. For example, these refrigerated CFL bulbs take several minutes to warm up enough to produce light. Also, a refrigerated CFL bulb is very inefficient and at −20 degrees Fahrenheit may make less than 10% output when energized. Another problem associated with CFL bulbs in refrigerated spaces stems from the fact that the light fixtures are typically positioned over the door leading into the refrigerated space. This positioning of the light fixtures means that the bulb must project light outwardly from its end to illuminate the far end of the refrigerated space. A CFL bulb however does not project light very well in this direction due to the configuration of the CFL bulb and therefor the far end of the refrigerated space distal the door may not be properly illuminated. Lastly, CFL bulbs include mercury which may be harmful to the environment when improperly disposed.

In an effort to overcome the problems associated with incandescent and CFL lights designers are now utilizing LED lights in cold room environments. However, a problem with LED lights is that they are typically enclosed within a housing to protect them from the cold room environment. The enclosing of the LED lights leads to another problem which is that the LED lights do not have an efficient way of dissipating heat which causes damage to the LEDs. As such, during the construction of the cold space or during times when the cold space is not cooled, the use of the LED lights leads to an overheating of the light and damage to the LED lights. Another problem with LED lights is that the LED diodes or light elements are susceptible to being harmed if they are contacted by a person.

Accordingly, it is seen that a need remains for an LED light fixture which may be placed in a refrigerated space without overheating and which restricts direct access of the LED light elements. It is to the provision of such therefore that the present invention is primarily directed.

SUMMARY OF THE INVENTION

In a preferred form of the invention a LED light comprises a housing having a first portion and a second portion removably coupled to the first portion to define a housing interior space. The second portion has an interior surface and an exterior surface opposite the interior surface and a plurality of first screw mounting holes extending between the exterior surface and the interior surface. The LED light also includes a LED light panel coupled to the exterior surface of the housing second portion, and a lens coupled to the exterior surface of the housing second portion and covering the LED light panel with the lens being a unitary structure with a plurality of second screw mounting holes configured align with the first screw mounting holes of the housing second portion. The LED light also has a plurality of first mounting screws having a head positioned within the housing interior space and a shaft extending through the first screw mounting holes of the housing second portion and threaded into the second screw mounting holes of the lens, and a power supply circuit positioned within the housing interior space and electrically coupled to the LED light panel.

DETAILED DESCRIPTION

Figure 1:
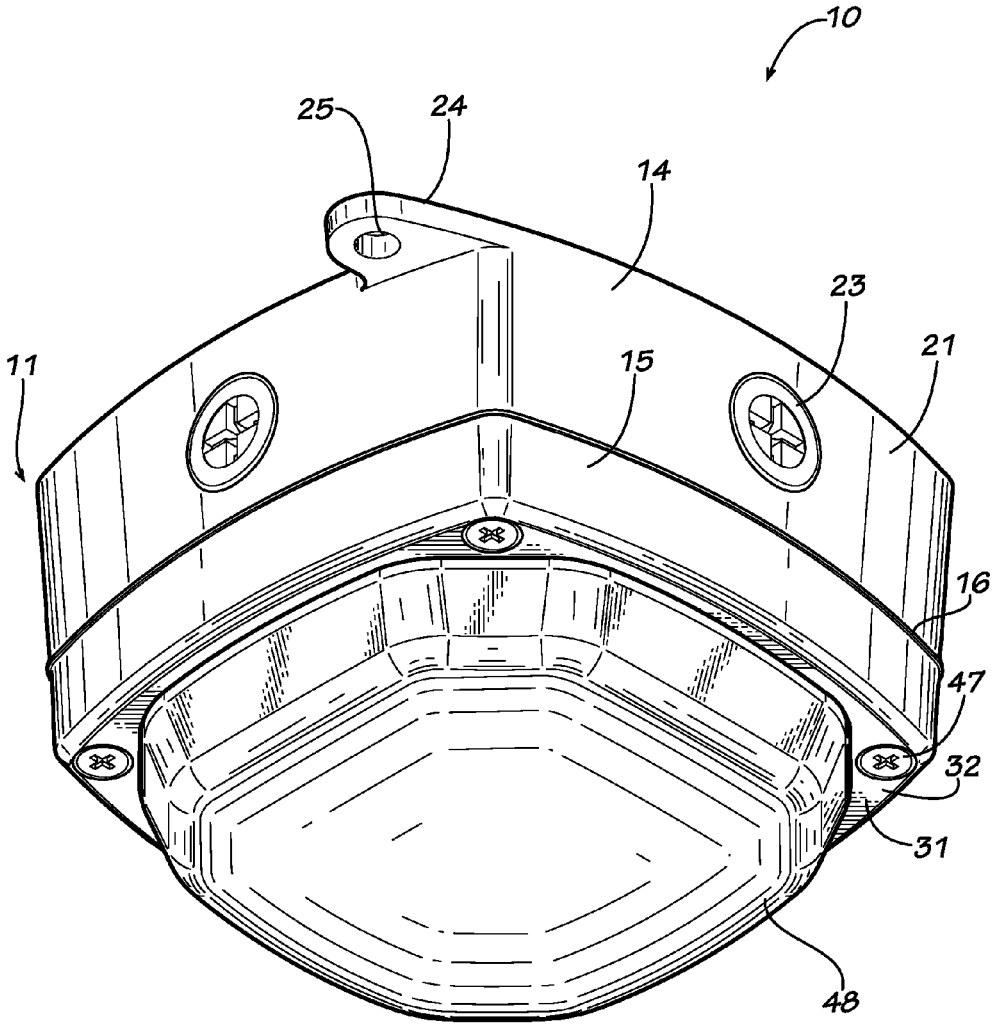
FIG. 1 is a perspective view of a LED light embodying principles of the invention in a preferred form.
Figure 2:
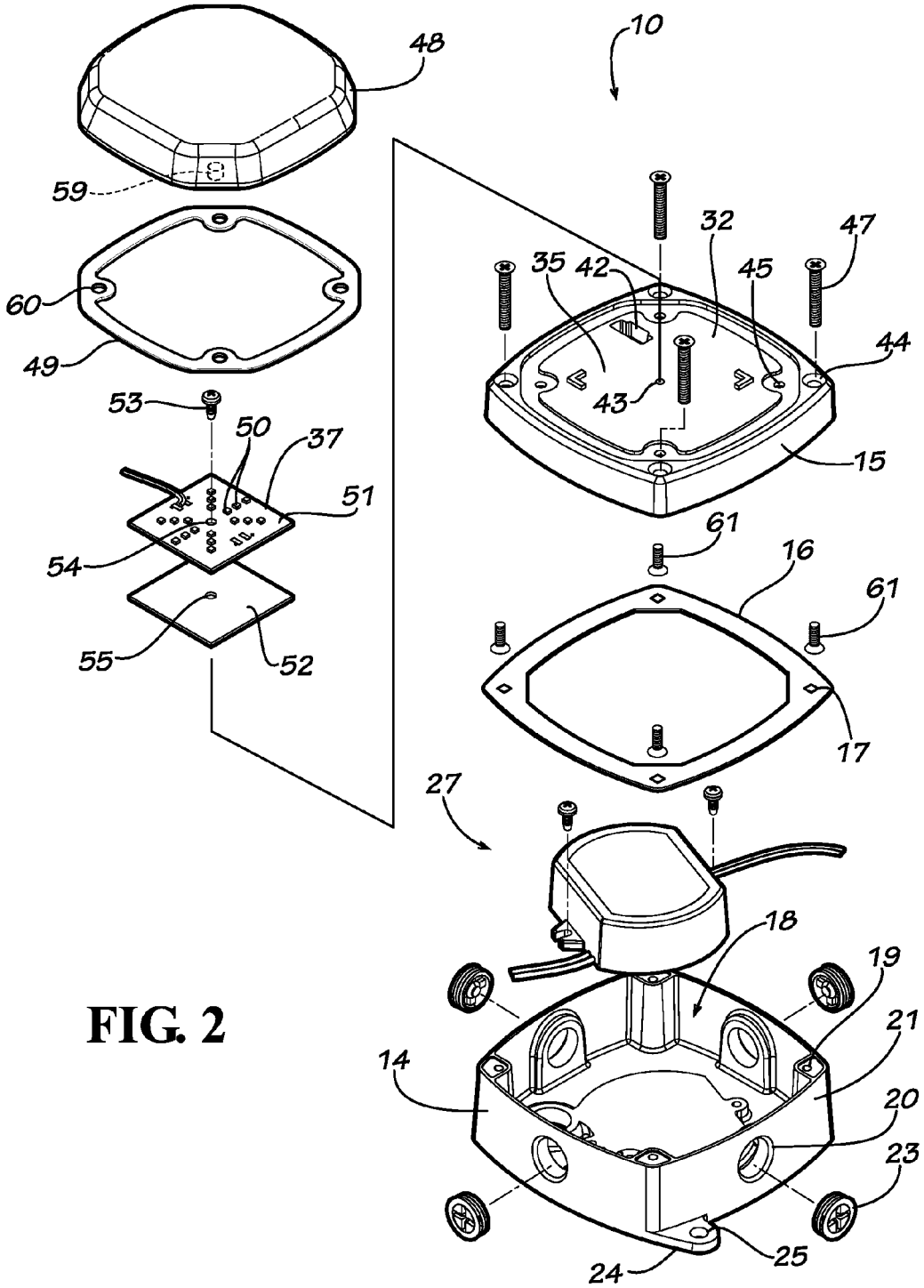
FIG. 2 is an exploded perspective view of the LED light of FIG. 1.
Figure 3:
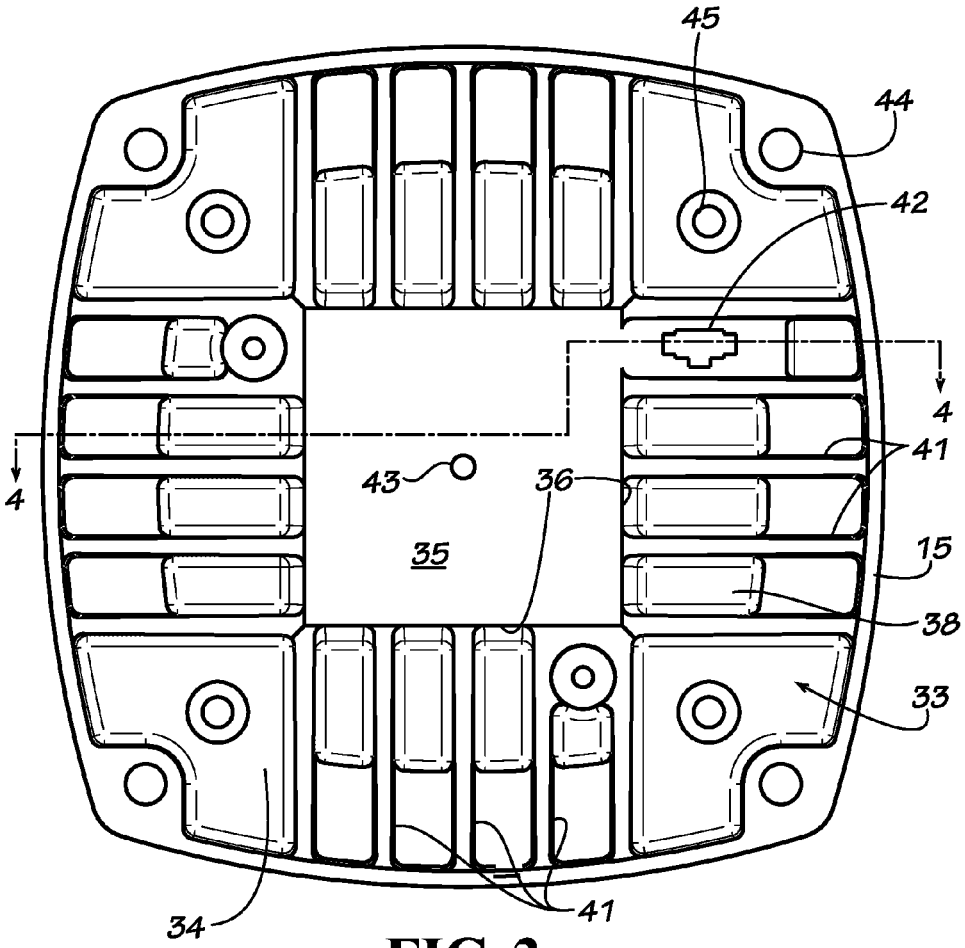
FIG. 3 is a bottom view of the upper housing of the LED light of FIG. 1.
Figure 4:
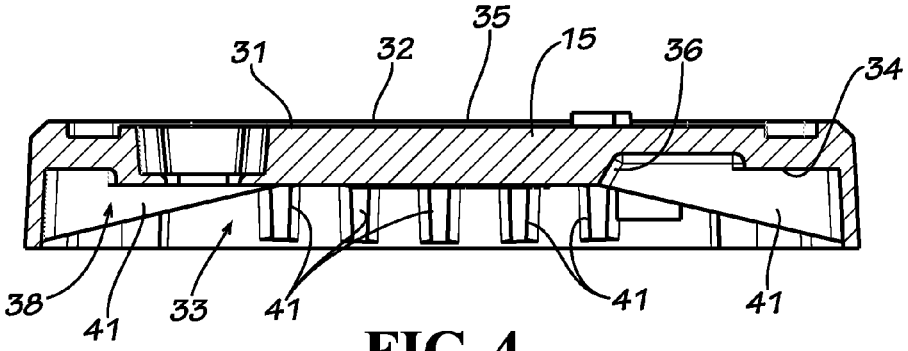
FIG. 4 is a cross-sectional view of the upper housing of the LED light of FIG. 1.

With reference next to the drawings, there is shown a LED light 10 according to the present invention. The light 10 has a main housing portion or housing 11 and a lighting portion 12.

The housing 11 includes a base, junction box or main lower housing 14 (first portion), a corresponding main upper housing 15 (second portion), and a base gasket 16 positioned between the lower housing 14 and upper housing 15. The thermally insulative base gasket 16 is positioned between the upper housing 15 and the lower housing 14. The base gasket 16 has four mounting holes 17 and is preferably made of a thermally insulative vulcanized fiber material. The upper and lower housings are preferably made of a thermally conductive material such as an aluminum alloy.

The lower housing 14 includes a large well, cavity or recess 18, four internally threaded housing mounting holes 19, and four conduit openings 20 extending through each of the four sidewalls 21 which define the recess 18. Each conduit opening 20 has a threaded plug 23 therein which seals the opening. A pair of oppositely disposed mounting flanges or ears 24 extend outwardly from the sidewalls 21, each of which includes a wall mounting hole 25 therethrough. A mounting bolt or screw may be passed through the wall mounting hole 25 and into the underlying structure to mount the light 10 to the underlying structure, such as the refrigerator interior wall.

A power supply circuit or power supply 27 which includes a power transformer and the conventional electronics required to operate LED type lights, is mounted within the recess 18 and has electrical wires extending to the exterior through one of the conduit openings plugs 23 adapted to receive electrical wires therethrough.

The upper housing 15 has a top wall 31 with a top surface 32 and a well, cavity or recess 33 extending from a bottom side so as to define a recessed bottom surface 34 opposite the top surface 32. The bottom surface 34 is raised in a central region to define a generally square, central mounting area 35 defined by four boundary walls 36, which generally corresponds to the area below which an LED array 37 is mounted as described in more detail hereinafter. The wall thickness of the central mounting area 35 is thicker than the wall thickness of the peripheral margin 38 surrounding the central region 35. The term thickness as used herein is the size of the wall between the exterior top surface 32 and the interior bottom surface 34. The upper housing 15 also includes a plurality of heat dissipating heat pipes, bridges, stanchions, or ribs 41 within the peripheral margin 38, shown as five ribs, extending between each boundary wall 36 of the mounting area 35 and the sidewalls 21. The ribs 41 increase in height, and therefore overall mass, as the ribs 41 extend outwardly toward the sidewalls 21. The upper housing 15 also has an electronic coupler passageway 42, a central LED array mounting hole 43, four housing mounting holes 44, and four lens mounting holes 45, wherein each lens mounting hole 45 is positioned closely adjacent one of the four housing mounting holes 44 to insure a tight fit between the components. Threaded housing mounting screws 47 extend through the housing mounting holes 47 of the upper housing 15, through the base gasket mounting holes 17, and threadably into the housing mounting holes 44 of the lower housing 14 to seal the upper housing 15 to the lower housing 14 with the head of the mounting screws 47 on the exterior of the housing and the screw shaft extending through the mounting holes.

The lighting portion 12 includes the LED light panel or light array 37, a lens 48, and a lens gasket 49. The LED light array 37 includes a plurality of LED light elements or diodes 50 mounted to a conventional LED board 51. The LED light array 37 is coupled to an underlying LED pad 52 and mounted to the top surface 32 of the upper housing 15 at the location of the central mounting area 35. The LED light array 37 is mounted to the upper housing 15 with a mounting screw 53 extending through an array mounting hole 54 in the LED light array board 51 and a pad mounting hole 55 in the LED pad. The LED light diodes 50 are preferably arranged in a radially extending pattern of three LED diodes 50 per radial line. The number and arrangement of LED light diodes 50 may vary according to the amount of produced light and distribution of produced light that is desired. The LED array 37 is electrically coupled to the power supply 27 through an electrical coupler extending through the upper housing electronic coupler passageway 42. The LED pad 52 is made of a thermally conductive material, preferably a silicon/rubber type material such as that sold under the tradename Sil-Pad 900S made by Bergquist Company of Chanhassen, Minn. The LED pad 52 is made of thermally conductive material, preferably a silicon/rubber type material, which aids in transferring heat from the LED lights to the central mounting area 35 of the upper housing.

The lens 48 is generally a transparent or translucent cover and may be made of a shatter resistant plastic material, such as polycarbonate material. The lens 48 is a low profile lens to throw just enough light to the sides for distribution in a room without exceeding the limits of energy efficient guidelines for the surface mounted luminaire category, for example, which requires 75% of the light in the angle of 1 to 60 degrees from nadir. The lens 48 is of unitary construction and has four internally threaded lens mounting holes 59 therein which eliminate the need for an additional lens bracket associated with lights of the prior art. The term unitary construction is intended to mean a lens that is mounted to the housing in one piece without the need of an additional mounting bracket or the like. The lens gasket 49 has an open central region and four mounting holes 60 generally aligned with upper housing lens mounting holes 45. A lens mounting screw 61 is passed up through each upper housing lens mounting hole 45, through each lens gasket mounting hole 60, and threaded into each lens mounting hole 59 to sealably couple the lens 48 to the top surface 32 of the upper housing 15. The lens mounting hole 59 may be a hole within the sidewall of the lens or a boss having a mounting hole therein. As such, the head of the mounting screw 61 is positioned within the interior of the housing which the shaft of the screws passing through the screw mounting holes, so that the screw head is not accessible to a person without first disassembling the two housing portions. The mounting screws 61 are generally parallel and extend in a direction opposite to mounting screws 47.

In use, the lens mounting screws 61 that hold the lens 48 to the upper housing 15 are not accessible from the exterior of the light 10. To access the LED array 37 one must remove the lens 48 from the upper housing 15. To do so, the housing mounting screws 47 must first be unthreaded from the lower housing mounting holes 19, thereby allowing the upper housing 15 to be separated from the lower housing 14. The lens mounting screws 61 are then accessible wherein they may be unthreaded from the lens mounting holes 59 to allow the lens 48 to be separated from the upper housing 15. Only now is the LED array 37 accessible to a person. Mounting the lens mounting screws 61 in an exteriorly inaccessible position prevents people from easily removing the lens and thereby prevents them from touching and thereby damaging the LED array 37.

With the LED array 37 mounted to the central mounting area 35 of the upper housing 15, heat generated by the LED array 37 is transferred or conveyed to the central mounting area 35, which acts as a heat sink. The heat conveyed to the central mounting area 35 is then conveyed through the upper housing top wall 31 to the peripheral sidewalls 21. The ribs 41 also aid in conveying the heat from the central mounting area 35 to the sidewalls 21. It is believed that the increasing height of the ribs 41 aids in conveying the heat towards the sidewalls in a faster manner as the mass is increased as the ribs extend outwardly towards the sidewalls. It should be noted that the present light is designed to be mounted within a cold room environment. As such, the exterior walls, including sidewalls 21, are directly exposed to the cold environment of the cold room and thus allows the heat to be quickly and efficiently dissipated. However, during times when the environment is not cooled, the heat sink and ribs still dissipate heat in a manner to prevent the overheating of the LED lights.

It thus is seen that a cold room light is now provided which overcomes problems associated with the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A LED light comprising, a housing having a first portion and a second portion removably coupled to said first portion to define a housing interior space, said second portion having an interior surface and an exterior surface opposite said interior surface and a plurality of first screw mounting holes extending between said exterior surface and said interior surface;

a LED light panel coupled to said exterior surface of said housing second portion;

a lens coupled to said exterior surface of said housing second portion and covering said LED light panel, said lens being a unitary structure with a plurality of second screw mounting holes configured align with said first screw mounting holes of said housing second portion;

a plurality of first mounting screws, each said first mounting screw having a head positioned within said housing interior space and a shaft extending through said first screw mounting holes of said housing second portion and threaded into said second screw mounting holes of said lens, said housing second portion has third screw mounting holes extending from said exterior surface to said interior surface, and wherein said housing first portion has fourth screw mounting holes aligned with said housing second portion third screw mounting holes, and further comprising second mounting screws having a head portions position to abut said housing second portion exterior surface and a shaft portions extending through said housing second portion third screw mounting holes and threaded into said housing first portion fourth screw mounting holes, and a power supply circuit positioned within said housing interior space and electrically coupled to said LED light panel.

2. The LED light of claim 1 wherein each third screw mounting hole is positioned closely adjacent one first screw mounting hole.

3. A LED light comprising, a housing having a base portion and a cap portion coupled to said base portion, said cap portion having a top wall and sidewalls extending from said top wall, said top wall having a central region and a peripheral margin at least partially about said central region, said peripheral margin including a first set of screw mounting holes and a second set of screw mounting holes, said base portion having a third set of screw mounting holes configured to align with said second set of screw mounting holes;

a plurality of LED light elements mounted to said top wall central region;

a lens coupled to said housing cap portion top wall and positioned to cover said plurality of LED light elements, said lens having a fourth set of screw mounting holes configured to align with said first set of mounting holes;

a first set of mounting screws having a head portion abutting said cap portion top wall and a shaft portion extending through said second set of screw mounting holes and threadably into said third set of screw mounting holes, and a second set of mounting screws having a head portion positioned within said housing and a shaft portion extending through said first set of screw mounting holes and threadably into said fourth set of screw mounting holes.

4. The LED light of claim 3 wherein said first set of mounting screws and said second set of mounting screws are generally parallel to each other and extend in opposite directions to each other.

5. The LED light of claim 3 wherein said lens is of a unitary construction which includes said fourth set of screw mounting holes.

6. The LED light of claim 3 further comprising a power supply circuit electrically coupled to said LED light elements.

7. The LED light of claim 3 wherein each said screw mounting hole of said first set of screw mounting holes is positioned closely adjacent one said screw mounting hole of said second set of screw mounting holes.

* * * * *